United States Patent [19]

Heijenga

[11] Patent Number: 4,921,137

[45] Date of Patent: May 1, 1990

[54] DISPENSING CONTAINER FOR A LIQUID OR PASTE-LIKE SUBSTANCE

[75] Inventor: Berend Heijenga, Almelo, Netherlands

[73] Assignee: HSM, Almelo, Netherlands

[21] Appl. No.: 215,290

[22] Filed: Jul. 5, 1988

[30] Foreign Application Priority Data

Jul. 17, 1987 [NL] Netherlands ..... 8701700

[51] Int. Cl.[5] ..... B65D 35/14

[52] U.S. Cl. ..... 222/107; 222/541; 222/564; 206/632; 53/479

[58] Field of Search ..... 222/92, 107, 541, 564, 222/547; 206/610, 628, 632, 434; 53/479

[56] References Cited

U.S. PATENT DOCUMENTS

| | | | |
|---|---|---|---|
| 1,438,487 | 12/1922 | Greene | 222/107 |
| 2,894,510 | 7/1959 | Bellamy | 222/541 |
| 2,941,694 | 6/1960 | Harman | 222/107 |
| 2,947,653 | 8/1960 | Fohr | 222/107 |
| 2,962,192 | 9/1958 | Volckening . | |
| 3,913,734 | 10/1975 | Siegel . | |
| 4,183,434 | 1/1980 | Watt | 206/632 |
| 4,631,901 | 12/1986 | Chung et al. | 53/479 |

FOREIGN PATENT DOCUMENTS

| | | |
|---|---|---|
| 0223581 | 5/1987 | European Pat. Off. . |
| 2726722 | 1/1979 | Fed. Rep. of Germany . |
| 3122237 | 1/1983 | Fed. Rep. of Germany . |
| 2401847 | 3/1979 | France . |
| 926159 | 5/1963 | United Kingdom . |
| 1141810 | 2/1969 | United Kingdom . |
| 87/00819 | 2/1987 | World Int. Prop. O. . |

*Primary Examiner*—H. Grant Skaggs
*Attorney, Agent, or Firm*—Larson and Taylor

[57] ABSTRACT

A dispensing container for a liquid or paste-like substance, consisting of two sheets of foil material, the edges of which are interconnected by means of a liquid-tight connecting seam, enclosing therebetween a filling space, the interior of the filling space communicating with a tube fixed in the connecting seam, the tube forming an outflow opening, the sheets being extended beyond the end of this tube to form a handle, and being interconnected there in a liquid-tight manner in order to close the dispensing opening of the tube, at least a portion of these extended sheet portions being adapted to be loosened in order to uncover the dispensing opening of the tube so as to allow to dispense the contents of the filling space, which is characterized in that the connecting seam between the foil sheets (1) near the tube (5) is provided with a preformed channel portion (4) in which the tube (5) is fixed in a liquid-tight manner, the channel (4) being extended (4') beyond the extremity of the tube (5) and into the handle portion (6), in that the tube (5) is made of a rigid pressure-elastic material, and in that the diameter of the bore (10) of the tube (5), depending on the viscosity and the surface tension of the contents (8) in respect of the tube material is, on the one hand, so small that the contents (8) in the closed condition of the container will be kept by the surface tension outside the bore (10) of the tube (5), and, on the other hand, the diameter of the bore (10) of the tube (5) is so large that, therein, no capillary effect occurs which would enhance the penetration of the contents (8) therein.

12 Claims, 1 Drawing Sheet

DISPENSING CONTAINER FOR A LIQUID OR PASTE-LIKE SUBSTANCE

Figure 1:
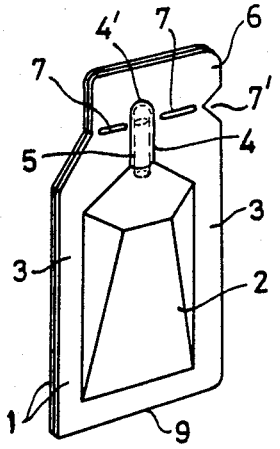

The invention relates to a container for a small quantity of a liquid or paste-like product, such as, for example nutritional, pharmaceutical, cosmetical or technical products, and, in general, to a container intended for a single doses of such products. Examples thereof are coffee-milk or cream, mayonaise, mustard, but also eye- or nose-drops, and, furthermore glue, lubricating oil, chemicals and the like.

For coffee-milk or cream, packages in the shape of a small tub are known which, in the filled condition, are closed in an air-tight manner by means of a cover sheet, which cover sheet can be fully or partly pulled away from a given point in order to provide an opening for dispensing the contents.

Such packages, however, have several disadvantages. When removing the cover sheet, a relatively large opening is formed, which is too large for dispensing doses, in particular jet- or drop-wise. Moreover, when pulling away the cover sheet, and if the connecting seam between the cover sheet and the container proper is broken, a part of the contents will easily splash outwards, which will also be the case if opening takes place in surroundings having a lower air pressure, such as in aeroplanes. If the contents are not completely dispensed, the remainder can flow out of a toppled container.

From U.S. Pat. No. 2,962,192 containers for dispensing liquid contents are known, comprising two flexible foil walls which, along their edges, are sealingly interconnected by means of a connecting seam, e.g. by welding or the like, thus forming a closed space for the contents. In a point of this container a dispersing passage in the shape of an elastic tube is provided which is sealed near the dispensing point between these foil walls. The tube extending from the container is outwardly surrounded in a sealed manner by extensions of said foil walls. Said extensions have the shape of a handle, and possess a tear line which is directed transversely to the tube. When torn along said tear line, the handle can be removed beyond the extremity of the tube so that its opening is uncovered and the contents can be pushed outwards by compressing the flexible walls of the package. When opening the package, however, the extremity of the tube is to be pinched between the thumb and forefinger, and, at the same time, the handle is to be torn off. Only then it is possible to open the package without the contents flowing out untimely and unintentionally. For dispensing drop-wise, the extremity of the tube is to be alternately compressed and released. This is, of course, laborious, and for administering eye-drops even totally unsuitable.

Another objection of this container is that, after sealingly interconnecting the extensions of the foil walls serving as a handle, a small space is formed beyond the extremity of the tube which, during storage of the container, will be automatically filled with a portion of the liquid, so that, when tearing off the handle, this portion can splash away.

Moreover the use of an elastic tube causes the considerable problems during manufacturing, and then, moreover, there is a risk that, when sealingly interconnecting the foil walls and the tube under pressure and at a high temperature, the opening of the tube will be partly or completely closed by melting. At lower temperatures, capillary passages can be formed between the tube and the adjoining foil layers, thus making the package untight or causing the tube to get loose.

In another container of this kind, known from DE-A 2 312 549, tubes with a stepped outer wall are used, the portion with the largest diameter being fixed between the foil layers, and the narrower portion extending beyond a tear line. The handle is, then, to be torn off by a rotational movement in order to be removed from the extending tube. Although such tubes having a thicker portion can be fixed better between the foil layers, the production of tubes with a stepped outer wall leads to substantial costs, i.a. because it is difficult to position such tubes in the correct way inside the partially completed container. The protruding extremity of the tube impedes the tearing of the handle.

From DE-C 2 215 215 a similar container is known, in which a wire is inserted into a passage between the foil sheets forming the container, which wire is to be removed after opening, and is, to that end, provided with a handle. U.S. Pat. No. 3,930,500 describes a similar container in which the wire extremity extending from the passage is clamped between extensions of the foil sheets to be torn off. When tearing off the handle, the wire can be pulled away together therewith in order to unblock the dispensing channel. In such containers considerable problems are met with, i.a. when clamping the wire and introducing it into the channel, and, moreover, there is a risk of forming capillary passages if the wire does not completely close the channel.

The invention relates to a container for relatively small quantities of a liquid or paste-like product, consisting of two sheets of a plastic foil or metal foil coated with plastics or the like, the edge portions of which being impermeably interconnected by means of a sealing seam, and defining a hollow space for the contents, which interconnected foil sheets are being extended, in the vicinity of an outflow opening, to form a handle, said extensions surrounding said outflow opening, said handle being adapted to be removed along a tear line so as to release the outflow opening for the contents of the filling space.

The container according to the invention is characterised in that the connection seam between the foil sheets is provided, at the tube, with a preformed channel portion in which said tube is sealingly fixed, said channel extending beyond the extremity of the tube into the handle portion, in that said tube is made of a rigid pressure-elastic material, and in that the diameter of the bore of said tube, depending on the viscosity and the surface tension of the contents and relative to the material of the tube, is, on one hand, so small that the contents in the closed condition of the container is kept outside of the bore of the tube by the surface tension, and, on the other hand, the diameter of the bore of said tube is so large that, therein, no capillary action occurs which would enhance the entry of the contents therein.

The tube made of a relatively rigid but pressure-elastic material is resistant to the pressures and temperatures used when forming the liquid-proof connection, and will, then, only be deformed to a slightly unround shape, so that a completely sealed connection with the foil sheets performed to an adapted channel is obtained, and no liquid can flow off along the outer side of the tube. By a correct selection of the inner diameter of the tube and in connection with the viscosity and surface tension of the liquid and the material of the tube, it can be obtained that, in the filled condition, the contents of the container will not penetrate into the tube, so that during opening the contents cannot splash outwards.

Further favourable embodiments of the container of the invention are defined in the sub-claims.

Figure 2:
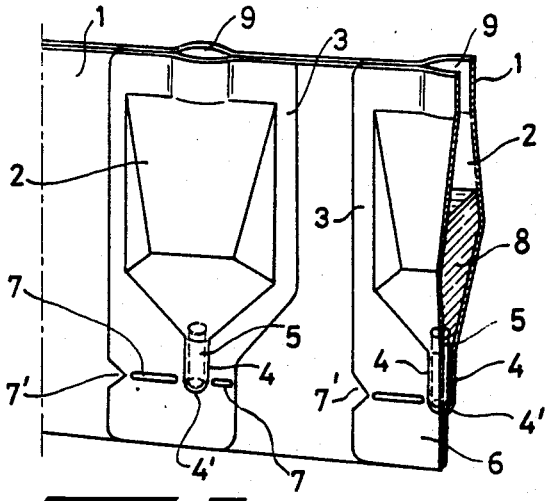
Figure 3:
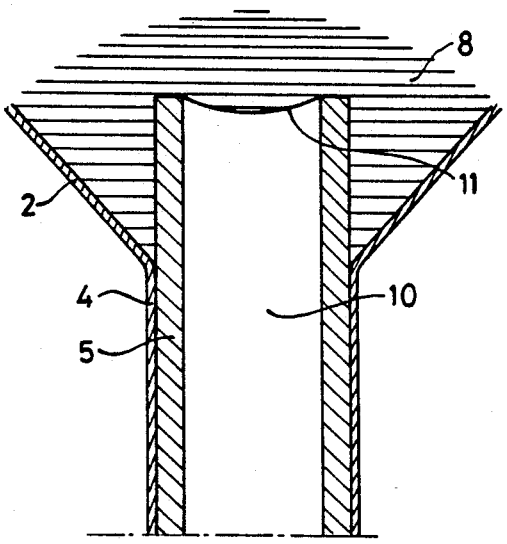
Figure 4:
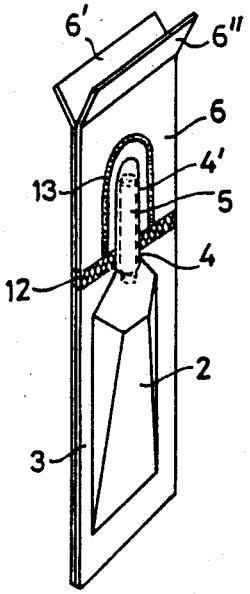

The invention will be elucidated below by reference to a drawing, showing in:

FIG. 1 a diagrammatic representation of a first embodiment of the container of the invention;

FIG. 2 a diagrammatic representation of the manner of manufacturing such a container;

FIG. 3 a highly enlarged representation for elucidating the behaviour of the contents of such a container at the inner side of the dispensing tube thereof; and FIG. 4 a representation corresponding to FIG. 1 of an other embodiment of the container of the invention.

The container of the invention shown in FIG. 1 consists of two sheets of foil material 1, each being provided with a bulged portion 2, said portions 2 defining together a filling space for the filling substance to be included in said container. The sheets 1 are sealingly interconnected in the marginal portion 3 around the bulges 2, e.g. by means of a welding seam. At the upper side the bulges 2 end in a channel 4 formed in the sheets 1, into which the channel a tube 5 is sealingly included. The marginal portion 3 is, moreover, extended beyond the extremity of the channel 4 to form a handle 6, where the sheets 1 are sealingly interconnected as well, and a line of weakness 7 is formed therein along which the handle 6 can be torn off, said line of weakness, for instance, begins in an edge recess 7'.

The channel 4 extends, as indicated at 4', beyond the extremity of the tube 5 into the handle portion 6, the line of weakness 7 intersecting this portion 4' near the extremity of the tube 5. In this manner the tearing movement for removing the handle 6 is not impeded by the extremity of the tube 5, which can be improved still more by slightly flattening the portion 4'. The tearing movement an take place continuously without the need of performing also a rotational movement, which highly simplifies the tearing action.

FIG. 2 diagrammatically shows the manner of manufacturing of such a container, and this after nearly completing a container which has already been filled with the contents 8. In the bottom portion 9 the edges 3 of the foil sheets 1 have not yet been interconnected, so that, there, a filling opening is kept open. Through this opening the tube 5 has been initially inserted, which tube, thereafter, during forming the circumferential connection between the edges 3 of the sheets 1, is sealingly connected with said sheets.

The tube 5 consists of a relatively rigid but pressure-elastic material which can be united with the sheets 1 by means of a suitable operation. This tube is, in particular, such that it can withstand the heat and pressure for connecting the sheets mutually and with said tube by heat and pressure, which tube can yield then, to such an extent that a circumferential sealing connection with the foil sheets 1 is obtained, the latter being previously shaped to form a channel 4, 4', said connection being obtained in particular in the points in which said sheets deviate from each other in the edge portions of the channel 4, the bore 10 of said tube, however, not being pinched thereby and not being closed by melting.

During one of said process steps also the portion 4' of the channel 4 will be slightly flattened. If desired also the portion of the bulges 2 above the contents 8 can be slightly flattened before the bottom portion 9 is sealingly closed too. This may be favourable sometimes in order to obtain a certain bellows effect for compensating pressure differentials between the interior of the container and the ambient air.

Forming the sealing seams and lines of weakness, and separating the completed containers from the continuous foil sheets 1 take place in the current manner, and needs not to be described in more detail.

FIG. 3 shows a highly enlarged representation of the inner end of the tube. The internal bore 10 of this tube is selected, depending on the viscosity and the surface tension of the contents 8 and the behaviour of said contents in respect of the material of the tube, in such a manner that the contents 8 will form, at the inner end of the bore 10, a coherent boundary surface 11, irrespective of the orientation of the container. The bore 10 is, on the other hand, not so narrow that, by capillary action, the contents 8 would be sucked into said bore. The bore 10 remains, therefore, always filled with air.

When the container is opened in a space having a lower air pressure than the pressure at which the container was filled, e.g., in an aeroplane, air will escape from the bore 10 when tearing off the handle 6, and only thereafter the contents 8 can enter the bore 10 under the influence of the internal pressure, but the internal friction, the viscosity and the surface tension prevent the expulsion of the liquid from the tube 5 completely or at least to a very large extent. Dispensing the contents will, then, be effected by squeezing together the bulged portions 2. Also if the container has not been completely emptied, the influence of the afore-mentioned forces, irrespective of the orientation of the container, will prevent that the contents will flow outwards through the tube 5, unless this is intended by the user.

It will be clear that, depending on the character of the contents, an adapted diameter of the bore 10 should be selected. In order to allow to use always the same devices for manufacturing such containers, tubes 5 having the same outer diameter but with an adapted diameter of the bore 10 are used for the different applications.

FIG. 4 shows a special embodiment of this container which mainly corresponds to that of FIG. 1. However the handle portion 6 is not provided with a line of weakness, but the sheets 1 remain loose at their extremities 6', so that they can be gripped there. If, then, the portions 6' are pulled away, the connection between the sheets 1 can be disrupted until the extremity of the tube 5 has been uncovered. In order to prevent a further pulling through of the sheets, a reinforced transverse connecting seam 12 can be provided which is sufficiently strong for avoiding a further tearing away of the sheets. For ensuring a good sealing of the free extremity of the tube 5, an additional sealing seam 13 can be provided, if necessary, around the portion 4' of the channel, which seam, when pulling apart the sheets 1, will be disrupted too.

It will be clear that, in the case of FIG. 4, the tube 5 should not be sealed between the foils 1 in the region of the U-shaped seam 13 since, otherwise, tearing apart the sheets would be impeded thereby.

It is, moreover, also possible to provide in the sheet portions 6 tear lines so as to allow to remove at least one of the sheet portions in the vicinity of the tube 5. On the other hand it is also possible in the case of FIG. 1 to provide a U-shaped seam 13 around the channel portion 4' if this would be desirable for improving the hermetic closure of the container.

The tubes 5 will generally be made of polyethylene and the sheets 1 will generally be made of a laminate, the inner side of which consists of a layer of polyethylene compatible with the tube material. The outer layers can be a metal foil or a plastics foil such as nylon.

I claim:

1. A dispensing container for a liquid or paste-like substance, comprising:

two superimposed sheets of foil material, interconnected by means of a liquid-tight heat-sealed connecting seam, peripherally enclosing between said sheets a filling space, the interior of said filling space containing a liquid or paste-like substance, said sheets being extended beyond said filling space to form a handle portion;

a channel pre-formed between said superposed sheets extending outwardly from said filling space into said handle portion;

a tube in said preformed channel, said tube being open at both ends, having its inner open end in fluid communication with said filling space forming an outflow opening for said filling space, said tube being heat-sealed at its periphery to said sheets in said channel in a liquid-tight manner to prevent outflow of said substance from said filling space through said channel outside said tube;

at least a portion of said extended sheet portions being adapted to be easily separated in order to uncover the outer open end of said tube so as to allow dispensing of the contents of said filling space;

said pre-formed channel extending a substantial distance beyond the outer open end of said tube end into said handle portion, said heat seal connecting said tube to said two sheets and said heat seal connecting said two sheets of foil material being located sufficiently remote from the outer open end of said tube such that the bore of said tube is not closed by melting;

said tube being made of a rigid pressure-elastic heat sealable plastics material which is resistant to the pressures and temperatures used when connecting said tube to said sheets of foil material in said liquid-tight manner, said tube being then deformed only to a slightly unround shape;

a tear line formed in said handle portion for gaining access to said tube to permit discharge of the contents of the container through said tube, said tear line being situated slightly beyond the outer open end of said tube and extending in a direction which passes through said portion of said preformed channel which extends beyond the outer open end of said tube;

the diameter of the bore of said tube depending on the viscosity and the surface tension of the contents of the container in respect of the tube material being, on the one hand, so small that said contents in the closed condition of the container will be kept by the surface tension outside the bore of said tube, and, on the other hand, the diameter of said tube being so large that no capillary effect occurs which would enhance the penetration of the contents of the container therein, whereby the contents of the container will not penetrate into the tube so that during opening, the contents will not splash outwards.

2. A container according to claim 1 wherein said extended channel portion is flattened.

3. A container according to claim 1 wherein said sheets enclosing a part of said filling space not filled with said substance are flattened.

4. A container according to claim 1 wherein part of said filling space, not filled with said substance, contains an inert gas.

5. A dispensing container for a liquid or paste-like substance, comprising:

two superimposed sheets of foil material, interconnected by means of a liquid-tight heat-sealed connecting seam, peripherally enclosing between said sheets a filling space, the interior of said filling space containing a liquid or paste-like substance, said sheets being extended beyond said filling space to form a handle portion;

a channel pre-formed between said superposed sheets extending outwardly from said filling space into said handle portion;

a tube in said preformed channel, said tube being open at both ends, having its inner open end in fluid communication with said filling space forming an outflow opening for said filling space, said tube being heat-sealed at its periphery to said sheets in said channel in a liquid-tight manner to prevent outflow of said substance from said filling space through said channel outside said tube;

at least a portion of said extended sheet portions being adapted to be easily separated in order to uncover the outer open end of said tube so as to allow dispensing of the contents of said filling space;

said pre-formed channel extending a substantial distance beyond the outer open end of said tube and into said handle portion, said heat seal connecting said tube to said two sheets and said heat seal connecting said two sheets of foil material being located sufficiently remote from the outer open end of said tube such that the bore of said tube is not closed by melting;

said tube being made of a rigid pressure-elastic heat sealable plastics material which is resistant to the pressures and temperatures used when connecting said tube to said sheets of foil material in said liquid-tight manner, said tube being then deformed only to a slightly unround shape;

the extended sheet portions being at their extremities not interconnected so as to form pulling tabs, by means of which said foil portions can be pulled apart to expose the outer open end of said tube;

the sheet at both sides of the channel being joined by means of a reinforced connecting seam which is directed substantially transversely to the axis of said tube, said reinforced connecting seam preventing the extended sheet portions from being pulled apart further;

the diameter of the bore of said tube depending on the viscosity and the surface tension of the contents of the container in respect of the tube material being, on the one hand, so small that said contents in the closed condition of the container will be kept by the surface tension outside the bore of said tube, and, on the other hand, the diameter of said tube being so large that no capillary effect occurs which would enhance the penetration of the contents of the container therein, whereby the contents of the container will not penetrate into the tube so that during opening, the contents will not splash outwards.

6. A container according to claim 5 wherein said extended channel portion is flattened.

7. A container according to claim 5 wherein said sheets enclosing a part of said filling space not filled with said substance are flattened.

8. A container according to claim 5 wherein part of said filling space, not filled with said substance, contains an inert gas.

9. A method of manufacturing a dispensing container for a liquid or paste-like substance which comprises:

superimposing two foil sheets having mutually symmetric bulges forming a filling space between said foil sheets, said superimposed sheets being extended beyond said filling space to form a handle portion and having opposed channel-forming portions which together form a pre-formed channel between said foil sheets, said preformed channel extending outwardly from said filling space and into said handle portion, said sheets being superimposed such that an opening is kept open between the superimposed sheets at a location on a side of the filling space remote from said channel, to provide access to said filling space;

inserting, through said opening, a tube into said channel, said tube being opened at both ends into position in said channel such that its inner open end is in fluid communication with said filling space and such that said preformed channel extends outwardly a substantial distance beyond the outer open end of said tube and into said handle portion, at least a portion of said extended sheet portions being adapted to be easily separated in order to uncover the open outer end of said tube so as to allow dispensing of the contents of said filling space;

heat sealing the foil sheets together to form a liquid-tight heat seal extending peripherally around said filling space such that a filling opening is kept open between the superimposed sheets and heat sealing the foil sheets to said tube such that said tube is fixed in said position in said channel and such that the tube is heat sealed at its periphery to said sheets in said channel in a liquid-tight manner to prevent outflow of said substance from said filling space through said channel outside said tube, said tube being made of a rigid pressure-elastic heat sealable plastics material which is resistant to the pressures and temperatures used when connecting said tube to said sheets of foil material in said liquid-tight manner, said tube being then deformed only to a slightly unround shape, said heat sealing being effected such that the heat seal between the tube and the two sheets and the heat seal between the opposed sheets are located sufficiently remote from the outer end of the tube such that the bore of the tube is not closed by melting;

filling said filling space, through said filling opening, with a liquid or paste-like substance; and heating sealing said filling opening to form a dispensing container, the diameter of the bore of said tube depending on the viscosity and the surface tension of the contents of the container in respect to the tube material being, on the one hand, so small that said contents in the closed condition of the container will be kept by the surface tension outside the bore of said tube, and, on the other hand, the diameter of said tube being so large that no capillary effect occurs which would enhance the penetration of the contents of the container therein, whereby the contents of the container will not penetrate into the tube so that during opening, the contents will not splash outwards.

10. A method according to claim 9 further comprising forming a tear line in said handle portion for gaining access to said tube to permit discharge of the contents of the container through said tube, said tear line being formed slightly beyond the outer open end of said tube and extending in a direction which passes through said portion of said preformed channel which extends beyond the outer open end of said tube.

11. A method according to claim 9 wherein the portion of the channel extending beyond the outer open end of said tube is flattened prior to forming said tear line.

12. A method according to claim 9 wherein the extended sheet portions are not interconnected at their extremities so as to form pulling tabs, by means of which said extended sheet portions can be pulled apart to expose the outer open end of said tube, and wherein said heat sealing further comprises heat sealing said superimposed sheets together at both sides of the channel to form a reinforced connecting seam which is directed substantially transversely to the axis of said tube, said reinforced connecting seam preventing the extended sheet portions from being pulled apart further.

* * * * *